US010195097B1

(12) United States Patent
Cimo

(10) Patent No.: US 10,195,097 B1
(45) Date of Patent: Feb. 5, 2019

(54) NEUROMUSCULAR PLASTICITY APPARATUS AND METHOD USING SAME

(71) Applicant: Gaetano Cimo, Laguna Niquel, CA (US)

(72) Inventor: Gaetano Cimo, Laguna Niquel, CA (US)

( * ) Notice: Subject to any disclaimer, the term of this patent is extended or adjusted under 35 U.S.C. 154(b) by 0 days.

(21) Appl. No.: 15/624,618

(22) Filed: Jun. 15, 2017

Related U.S. Application Data

(60) Provisional application No. 62/445,821, filed on Jan. 13, 2017.

(51) Int. Cl.

| | |
|---|---|
| ***A61H 1/00*** | (2006.01) |
| ***A61H 1/02*** | (2006.01) |
| ***A63B 21/00*** | (2006.01) |
| ***A63B 21/22*** | (2006.01) |
| ***A63B 23/035*** | (2006.01) |

(52) U.S. Cl.
CPC ..... *A61H 1/00* (2013.01); *A61H 1/0285* (2013.01); *A63B 21/0004* (2013.01); *A63B 21/22* (2013.01); *A63B 21/4035* (2015.10); *A63B 21/4049* (2015.10); *A63B 23/03516* (2013.01); *A61H 2201/1215* (2013.01); *A61H 2201/1638* (2013.01); *A61H 2201/1671* (2013.01); *A61H 2205/065* (2013.01)

(58) Field of Classification Search
CPC ..... A63B 21/4035; A63B 23/03516; A61H 1/0274; A61H 1/0285; A61H 2201/1671
See application file for complete search history.

(56) References Cited

U.S. PATENT DOCUMENTS 4,452,445 A * 6/1984 Csekes ..... A63B 21/0053 310/75 B
4,531,729 A * 7/1985 Wrinkle ..... A63B 21/0004 482/106
4,717,146 A * 1/1988 Nohara ..... A63B 21/00178 482/62
4,765,315 A * 8/1988 Krukowski ..... A63B 21/0056 482/5
4,973,046 A * 11/1990 Maxwell ..... A63B 21/00178 482/60
4,976,426 A * 12/1990 Szabo ..... A63B 21/00178 482/111
5,027,794 A * 7/1991 Pyle ..... A63B 21/00181 482/119
5,343,856 A * 9/1994 Proctor ..... A61H 1/0214 482/60
5,466,213 A 11/1995 Hogan et al.
(Continued)

*Primary Examiner* — Michael Tsai
*Assistant Examiner* — Christopher Miller
(74) *Attorney, Agent, or Firm* — Invention To Patent Services; Alex Hobson

(57) ABSTRACT

A portable motion control apparatus drives a user's extremity emulating the user's tremor. The driving motion entrains the tremor motion and stretches muscles evoking stretch reflexes in agonist and antagonist muscles used to maintain muscle tone. The motion applies a heightened and coordinated demand on the neuromuscular components of multiple stretch reflex circuits thereby effectuating neuromuscular plasticity; the retention of neuromuscular changes made to meet the heightened demands. Muscle tone is improved and tremor is suppressed for a protracted period.

23 Claims, 13 Drawing Sheets

(56) References Cited

U.S. PATENT DOCUMENTS 5,562,104 A * 10/1996 Hochberg ..... A61B 5/16 600/595
5,597,373 A * 1/1997 Bond ..... A63B 21/00178 482/1
5,738,636 A 4/1998 Saringer et al.
5,788,607 A * 8/1998 Baker ..... A61H 1/0285 482/4
5,860,941 A * 1/1999 Saringer ..... A61H 1/0214 482/4
5,902,218 A * 5/1999 Froelich, Sr. ..... A63B 21/4035 482/118
5,951,499 A 9/1999 Saringer et al.
6,106,491 A 8/2000 Gianutsos
6,599,255 B2 7/2003 Zhang
6,659,918 B2 12/2003 Schiessl
6,730,049 B2 5/2004 Kalvert
8,257,284 B2 * 9/2012 Gruben ..... A63B 24/00 600/587
9,044,630 B1 * 6/2015 Lampert ..... A63B 23/035
9,283,134 B2 3/2016 Leismer et al.
9,408,774 B2 8/2016 Rafaeli
9,616,266 B2 * 4/2017 Schroer ..... A63B 21/00
9,636,539 B1 * 5/2017 Brumit ..... A63B 22/0002
9,802,041 B2 * 10/2017 Wong ..... A61N 1/0456
2003/0092536 A1 * 5/2003 Romanelli ..... A61H 1/0214 482/60
2004/0033868 A1 * 2/2004 Van Straaten ..... A63B 21/005 482/110
2006/0094569 A1 * 5/2006 Day ..... A63B 21/015 482/57
2008/0139370 A1 6/2008 Charnitski
2008/0242508 A1 * 10/2008 Smith ..... A63B 21/0004 482/2
2008/0312052 A1 * 12/2008 Krietzman ..... A63B 21/0051 482/92
2013/0059696 A1 * 3/2013 Hijmans ..... A61H 1/0274 482/8
2014/0087921 A1 * 3/2014 Dietz ..... A61H 1/0285 482/45
2015/0272807 A1 * 10/2015 Gupta ..... A61H 1/0274 601/33
2015/0321000 A1 * 11/2015 Rosenbluth ..... A61N 1/0492 607/48
2017/0120104 A1 * 5/2017 Douglass ..... A63B 21/00069
2017/0291061 A1 * 10/2017 Lee ..... A63B 21/00069
2018/0043202 A1 * 2/2018 Johnson ..... A61H 3/04

* cited by examiner

NEUROMUSCULAR PLASTICITY APPARATUS AND METHOD USING SAME

CROSS REFERENCE TO RELATED APPLICATIONS

The application claims the benefit and priority to U.S. provisional patent application No. 62/445,821, filed on Jan. 13, 2017; the entirety of which is hereby incorporated by reference herein.

FIELD OF THE INVENTION

The invention relates to systems, devices and methods that effectuate neuromuscular plasticity and in particular the mitigation and long-term tremor suppression of neurological tremors.

BACKGROUND

There are a number of different tremor suppression methods that have limited effectiveness. Medication is marginally effective, may produce unwanted side effects, can be poorly tolerated and tend to lose their efficacy over time. Deep Brain Stimulation [DBS] requires a surgically implanted pacemaker type device. Experts are unclear how DBS works, but by sending high frequency electrical impulses into specific areas of the brain it can mitigate symptoms.

Tremor damping wherein shock absorbing devices are attached to a subject's hand. One such method employs a gyroscope; others utilize viscous liquids, elastic materials and magnetic fields. Such devices attenuate tremor as well as voluntary motion of the extremity they are attached to and have no lasting change. Tremor cancellation devices apply an opposing physical force that cancels the tremor. Such devices include exoskeletons that are worn over the arm or hand. They are affixed with active mechanisms that sense tremor motion and produce the opposing forces. Such devices may be uncomfortable, expensive and tend to suppress intentional motion. Tremor Isolation devices seek to isolate the tremor from a stabilized object. The subject grasps a platform that is loosely coupled to the object platform. As the object attempts to follow the tremor motion, its motion is sensed and converted to electrical output that drives actuators attached to the object platform with opposing forces thereby preventing the object from moving. Such systems do not attempt to suppress tremor, but allow it to be insulated from an object. Buildings are isolated from earthquakes, weapon systems from vibrating platforms and products like, Liftware, isolates a person's tremor from a utensil; spoon, scalpel, paint brush etc. Transcutaneous Electrical Nerve Stimulation (TENS) stimulation of selected afferent nerves may improve their performance leading to partial temporary tremor relief. Whole Body Vibration has been around for over 100 years when Jean-Marin Charcot prescribed sitting in a vibrating chair to treat tremor. Over the years, people have experienced various degrees of tremor suppression after being subjected to vibration from riding motorcycles, operation of power tools, riding in horse and buggy carriages and numerous other means of being subjected to low frequency vibration.

SUMMARY OF THE INVENTION

The invention provides a neuromuscular plasticity treatment device particularly configured as a tremor suppression apparatus and methods that suppress neurological tremors by improving performance of stretch reflexes that maintain muscle tone. The neuromuscular mechanisms of stretch reflexes are subjected to forced motion that heightens demands on them thereby evoking neuromuscular plasticity; the retention of neuromuscular changes made to meet the heightened demands.

Extremities at rest are maintained in a stable and ready to respond state referred to as muscle tone. Opposing muscles alternately contract causing the extremity to oscillate about the rest position. The stretch reflex is a closed loop circuit and the primary mechanism used to control muscle tone. When one muscle is stretched, the muscle spindles are stretched and sensory neurons propagate signals to the spinal cord; central nervous system, that in turn fire motor neurons that contract the stretched muscle. Overshoot causes the opposing muscle to stretch evoking a stretch reflex in the opposite direction. The alternating push and pull on the extremity is tremor. Normal tremor is hardly perceivable, large tremor is often simply referred to as tremor.

Tremors indicate the muscle tone dosed loop systems are working to try to stabilize about a target position, but a larger than normal magnitude of the oscillation indicates defects. Sensory neurons may be malfunctioning, neurotransmissions may be weak or attenuated, muscles may be hypersensitive or slow to respond and the interaction between reflex arcs may be compromised. Further, lack of stimulation may allow deterioration of all components. Consider the following example of a reflex arc defect that could be the cause of tremor.

The muscle at rest starts at a certain length. When the muscle is stretched, the muscle spindle stretches. When the muscle is released from the stretch and contracts, the muscle spindle becomes slack. The muscle spindle is rendered insensitive to further stretches of muscle. To restore sensitivity, gamma motor neurons fire and cause the spindle to contract, thereby becoming taut and able to signal the muscle length again.

Referring to FIG. 1, consider what happens if the muscle spindle is not contracted to keep it taut. In a muscle spindle that is taut under normal conditions, stretch is indicated immediately and accurately. In this case, the spindle indicates a correct 12 mm of stretch. However, in a spindle that is not taut, the slack must be taken up before it can indicate stretch. The spindle does not detect the first 16 mm of stretch and indicates to the central nervous system that the muscle has stretched 12 mm when it actually stretched 28 mm. Such a condition leads to an oscillation about the target or rest position with amplitude of 16 mm greater than normal. Another view is that a normal spindle will sense and thereby initiate a stretch reflex within 1 mm of stretch and a defective spindle will initiate a stretch reflex after 16 mm of stretch.

Neuroplasticity reorganizes the structure of the human organism to accommodate external demand. Repeated or heightened demand improves performance that is to be retained or remembered. This amazing capability is ubiquitous. It is occurring in all human organisms all the time. Neuroplasticity is the modification of the nervous system by making individual neurons larger and faster, activating dormant neurons or enlisting the services of neighboring neurons. Pathways may be changed, take detours around defective cells or create new or enlist additional pathways. In addition, neuroplasticity retains or remembers the modifications.

Muscle cells are also plastic. They become larger and new cells are created when stimulated repeatedly such as through repetitive exercise. They remain that way if stimulation continues, but as exercise is reduced or ceases, muscles reduce in size and speed. As used herein, neuromuscular plasticity is the restructuring of the nerves and the muscles used in reflex circuits that are important for maintaining muscle tone and balance. Muscle memory is a commonly used term that describes how practicing a given motion that involves multiple neuromuscular circuits are trained, improved and remembered. That is how a person perfects a golf swing. Practicing the correct swing over and over again creates muscle memory. Likewise, the brain experiences plasticity when a person repeats a phone number over and over again so it will be remembered.

The scientific community has long acknowledged the phenomenon Long Term Potentiation (LTP). Long Term Potentiation is a known form of synaptic plasticity. When nerve cells are subjected to stimulation, Long Term Potentiation is able to modify them and increase their performance. The modification persists for a protracted period, up to several weeks, following removal of the stimulation.

In these examples and many more, the modification and enhanced performance is remembered but tends to be forgotten if not used. However, when use is resumed, restoration takes less effort than was initially required to create the plasticity. It is believed that tremor is the result of poor muscle tone brought about by poorly responding stretch reflexes and that muscle tone can be greatly improved through training. Unlike man made machines, the human body can repair itself and improve strength, coordination and fluidity through training. But how does one train stretch reflex circuits.

Research and Experimentation

A series of experiments was conducted using various motion devices including configurations of the described apparatus to determine the motion parameters that yielded the best results. Four tremor subjects participated. Subjects A, C and D suffer from Parkinson's disease and Subject B suffers from physiological essential tremor.

Subject A suffers from Parkinson's Disease and realized nearly complete tremor suppression for eight hours following the use of a neuromuscular plasticity apparatus, as described herein. Subject A used said apparatus for about 15 minutes. He exercised when the tremor returned or sometime later. He realized positive results for every exercise session. Currently he exercises two to three times per week and has achieved a steady state of tremor suppression with occasional and brief episodes of reduced tremor.

Subject A Subject Analysis

In addition, a spectrum analysis was conducted on Subject A over a two day period. Table 1 shows the frequencies and amplitudes of Subject A's tremors measured with the spectrum analyzer.

TABLE 1

| Subject A | X | Y | Z |
|---|---|---|---|
| 10/16/16/10:08 | | | |
| Frequency | 6.3 | 6.3 | 7.4 |
| Amplitude | 0.43 | 0.72 | 3.05 |
| 10/16/17/14:17 | | | |
| Frequency | 7.4 | 7.4 | 7.4 |
| Amplitude | 1.92 | 2.42 | 17.27 |

TABLE 1-continued

| Subject A | X | Y | Z |
|---|---|---|---|
| 10/17/17/22:14 | | | |
| Frequency | 6.4 | 6.4 | 6.8 |
| Amplitude | 0.04 | 0.05 | 0.62 |

Subject B suffers from essential tremor. He commenced a series of tests using an alternative version of the apparatus. Initially he experienced a high degree of tremor suppression for 48 hours following 15 minutes of exercise. He then did 15 minutes of exercise every day and realized a sustained suppression of tremor with occasional, brief episodes of reduced tremor. Subject C suffers from Parkinson's Disease with prominent tremor in his left upper extremity. In his first exercise session, he realized nearly complete arrest of tremor for 18 hours following six minutes of exercise.

FIG. 2 is Subject C's tremor frequency and amplitude in three dimensions measured by a spectrum analyzer prior to the exercise session with an exemplary neuromuscular plasticity apparatus, as described herein. The neuromuscular plasticity apparatus was set to a frequency of 6.1 HZ to match the tremor frequency. A spectrum analysis of the apparatus was taken and depicted in FIG. 3. The apparatus was oriented such that the orbital motion was directed to the X and Y plane. Subject C exercised with the apparatus for six minutes. FIG. 4 is the "after" spectrum analysis of Subject C's tremor after the exercise session. Table 2 shows the "before" and "after" tremor amplitudes of Subject C and the calculated percentage improvement.

TABLE 2

| Subject C | X | Y | Z |
|---|---|---|---|
| Before | 0.64 | 1.19 | 1.19 |
| After | 0.02 | 0.00 | 0.02 |
| % Improvement | 96.88 | 100.00 | 98.32 |

The improvement was sustained for a protracted period and returned to approximately 50% after 18 hours. Subject C repeated the exercise for several days and realized similar results.

Subject D has Parkinson's Disease with prominent tremor in his legs. Tremor was measured with a spectrum analyzer and frequency was 5.7 HZ in both legs and in all three axes. Subject D exercised with an exemplary neuromuscular plasticity apparatus, as described herein. The "before and after" exercise amplitudes showed substantial improvement that was sustained for several hours when the user took his scheduled medication. At that point, tremor continued to be suppressed but the cause of the suppression, medication or exercise, could not be ascertained. Table 3 shows the "before" and "after" tremor amplitudes of Subject D's left and right legs, and the calculated percentage improvement.

TABLE 3

| Subject D | X | Y | Z |
|---|---|---|---|
| Right Before | 4.00 | 4.20 | 17.00 |
| Right After | 0.23 | 0.28 | 0.24 |
| % Improvement | 94.25 | 93.33 | 98.59 |

TABLE 3-continued

| Subject D | X | Y | Z |
|---|---|---|---|
| Left Before | 2.30 | 2.00 | 19.00 |
| Left After | 0.05 | 0.03 | 0.05 |
| % Improvement | 97.83 | 98.50 | 99.74 |

On several occasions, it was observed that following an exercise session and before taking the scheduled medication, tremor amplitude continued to decrease. Had there not been an exercise session, tremor would have continued to increase as the medication efficacy would have continued to decrease.

In the four subjects described in the experimentation, the application of a mechanical stimulation to a person's peripheral suppressed tremor for a protracted period. They experienced neuromuscular plasticity.

Three-dimensional spectrum analysis of several users was analyzed and several important observations were made. In nearly all cases, the tremor frequency of all three axes is the same or very close at any given time and the tremor frequency was equal to the resonant frequency of the stretch reflex.

From moment to moment or day to day, tremor frequency can vary by up to 20%. When amplitudes are very low, the signal to noise ratio is low and frequency measurements are obscured. Amplitude between axis varies from 1 axis being much higher than the other two axes; two axes being much higher than the third axis and all three axes being the same or similar. Amplitude from moment to moment or day to day can vary substantially.

Users on medication see a reduced tremor shortly after taking their medication and an increasing tremor as the medication efficacy decreases with time. In addition, there are several prevalent causes of increasing tremor amplitude including stress, fatigue, depression, fight or flight adrenalin surges and others.

The driving motion of an exemplary neuromuscular plasticity apparatus is designed to provide a driving motion with the same or similar frequency as the tremor at the time it is deployed. The phase between the tremor and the apparatus frequency will automatically become the same as the apparatus motion as it will entrain it. In an exemplary embodiment, the driving motion amplitude of the apparatus is set to exceed that of the tremor. It is not necessary for the driving motion amplitude to be a fixed multiple of the tremor in each axis however, exercising a reflex arc that is not defective causes no harm. Exercising a reflex arc that is defective is the objective. Therefore, applying a driving motion to all of the reflex arcs associated with the tremor is affective. It is important that the driving and tremor motions be substantially aligned. The apparatus easily accommodates motion in two axes in its simplest configuration and applying the motion to the third axis may be accommodated by reorienting the apparatus or the extremity, or both, with or without assisting attachments. Other configurations provide the forced motion in three dimensions simultaneously.

An exemplary neuromuscular plasticity apparatus is configured to be capable of delivering forced motion similar to that of the user's tremor with the ability to adjust frequency and amplitude. The results were positive. Long term suppression of tremor was observed.

Important observations include; the tremor frequency varies between subjects A and B; from one day or time to the next and there is relative consistency between axis at any one time.

Experimentation indicates that the motion should be set to the same frequency as the tremor. When the motion and tremor frequencies are the same the tremor oscillation is more easily entrained by the motion wherein the tremor phase is aligned with the motion phase or in sync and not in conflict. Put another way, the driven motion produced by exemplary neuromuscular plasticity apparatus and the motion of the tremor complement each other. It is believed that this is because the tremor frequency equals the resonant frequency of the reflex arc and their periods are equal to the reflex arc loop time, the time from muscle stretch detection to muscle relaxation. Stimulating the reflex arc at rates that are too high, or much higher than the tremor, does not allow the stretch reflex to complete before a new stretch reflex is evoked. Consider that nerves may be stimulated and complete transmission many times within the time it takes for a muscle to fully contract and relax. Stimulus rates of 30 HZ and above create Tonic Vibration Reflex; TVR, a state wherein the muscle is fully contracted and cannot relax. When the stimulus frequency is within the range of the tremor, each stretch reflex is completed and the mechanism that maintains muscle tone is fully exercised.

Tremor is a lack of muscle tone in a plurality of stretch reflex circuits, each comprising many components including, muscles, muscle spindles, sensory neurons, afferent nerves, central nervous system, interneurons, efferent nerves and motor neurons. The input to this complex system is the stretching of muscles. Each stretch in each muscle causes a stretch reflex. An exemplary neuromuscular plasticity apparatus stretches the muscles and thereby all of the stretch reflex components and circuits involved in the tremor motion, and is capable of stretching them in the correct sequence and at an effective rate or frequency. Repeated stimulus serves to exercise the muscle tone system thereby evoking plasticity.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
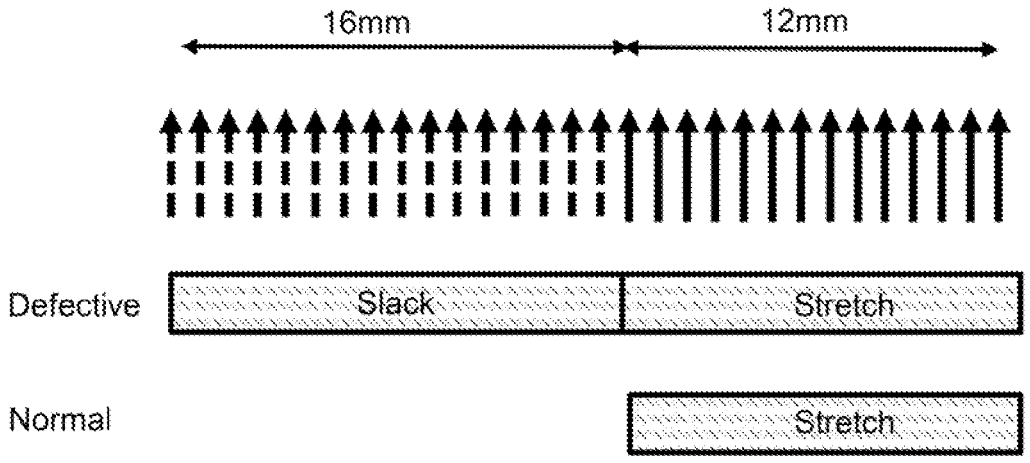
FIG. 1 shows a diagram of a muscle spindle that has a slack region and a stretch region.
Figure 2:
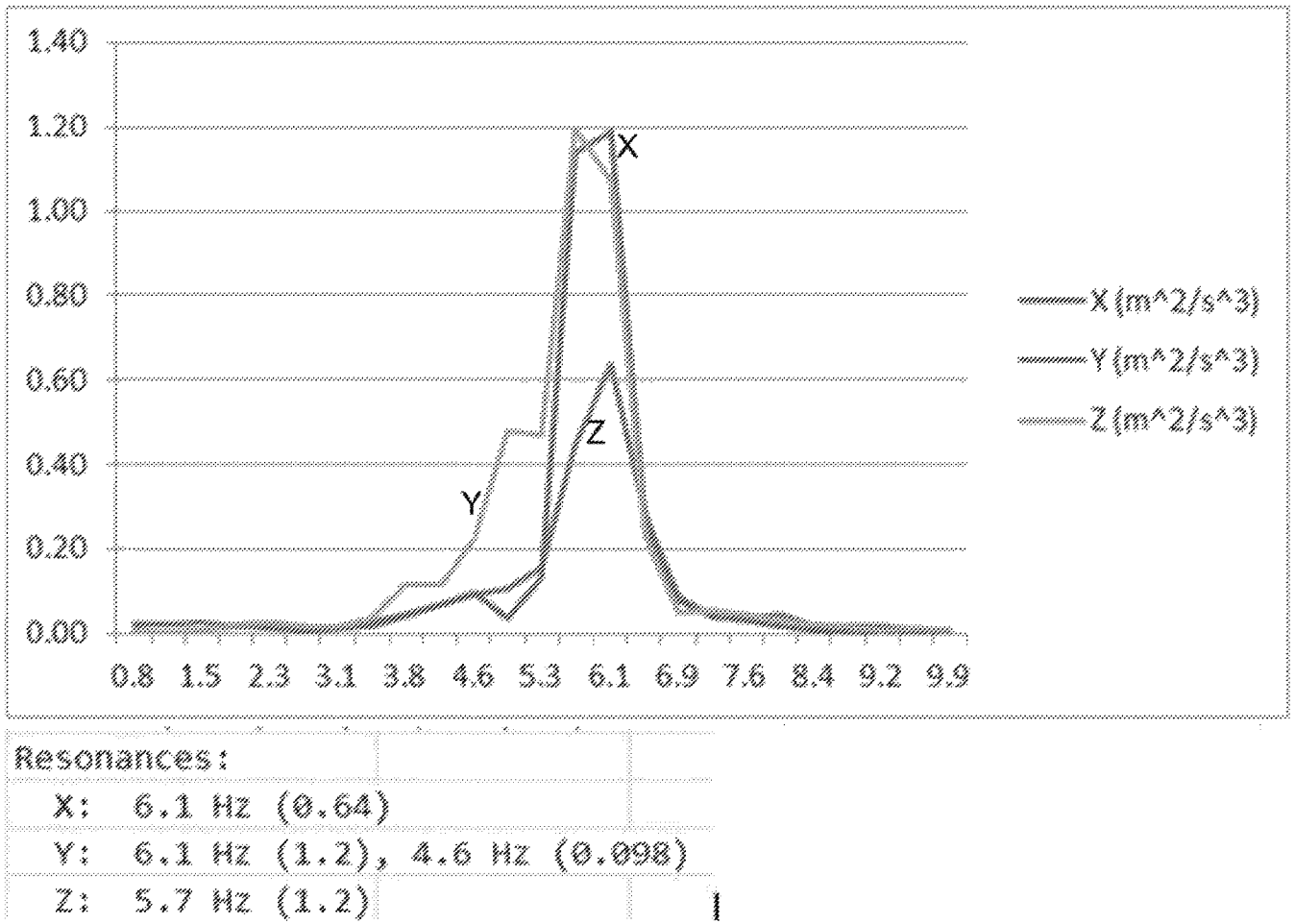
FIG. 2 shows the spectrum analysis of Subject C's tremor preceding an exercise session. Note the frequency in all three axes is approximately the same as are the amplitudes in the X and Y axis.
Figure 3:
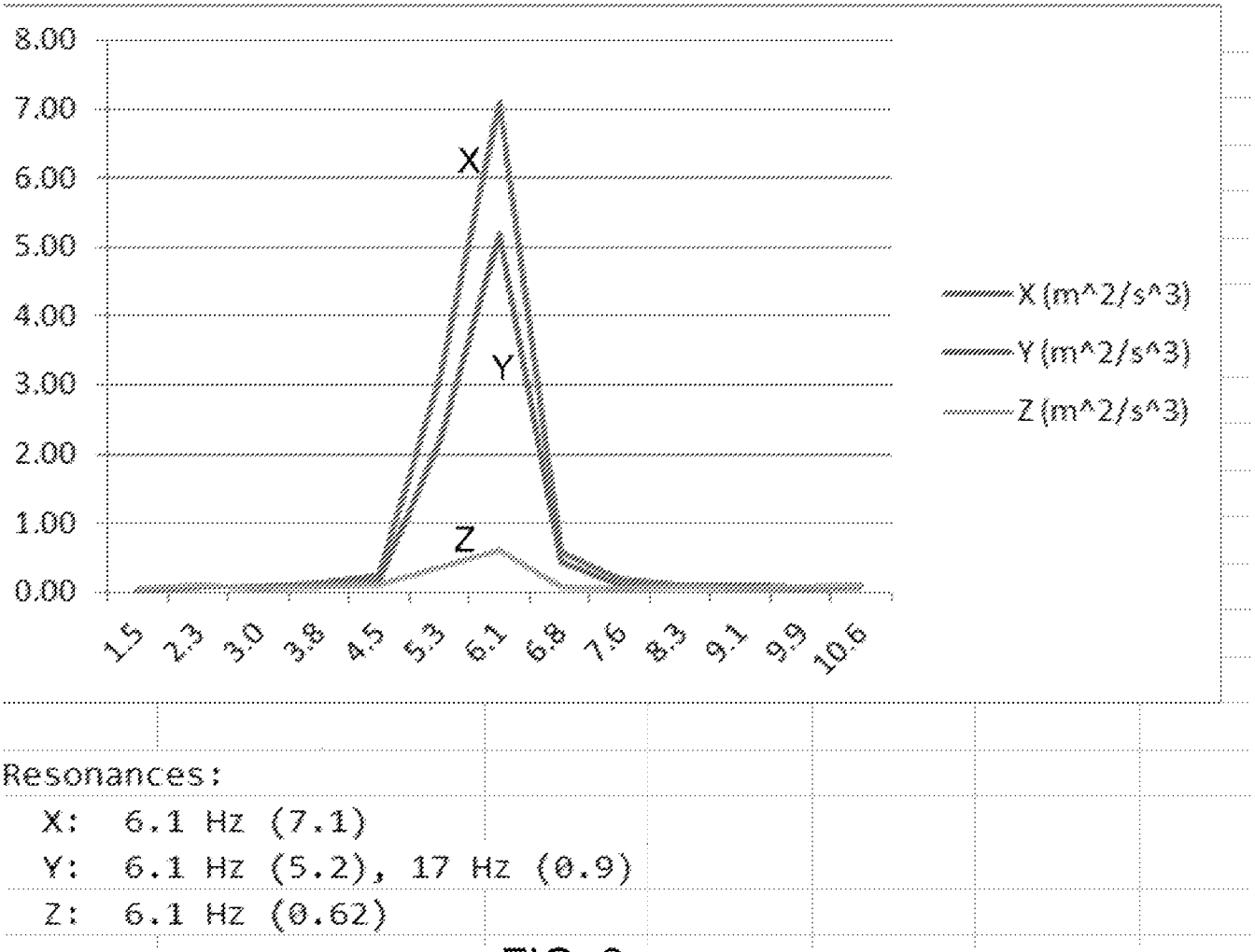
FIG. 3 shows the spectrum analysis of the apparatus used on Subject C during an exercise session. Note the similarity to FIG. 2.
Figure 4:
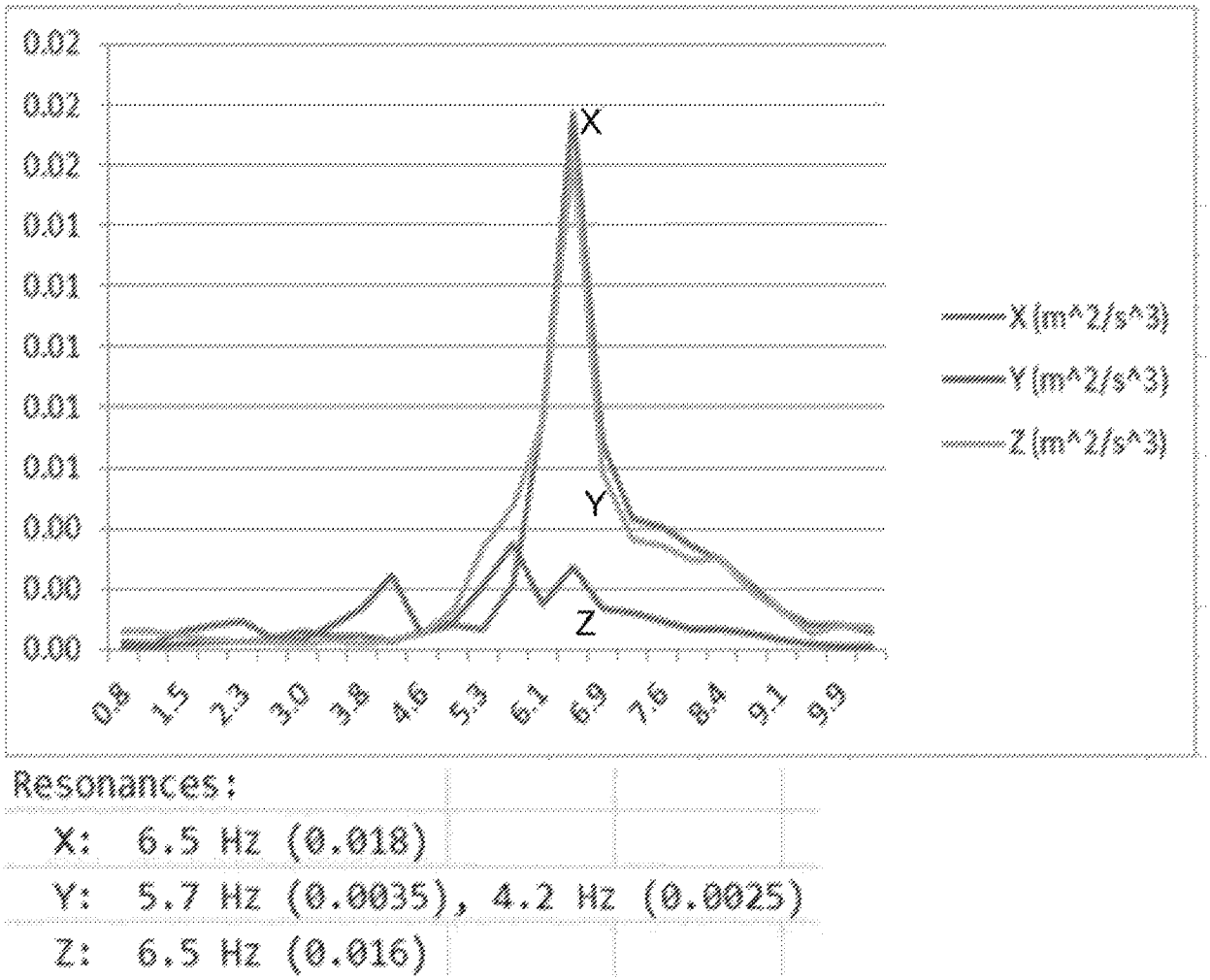
FIG. 4 shows the spectrum analysis of Subject C immediately following the exercise. Note the similarity to FIGS. 2 and 3.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

Neuromuscular plasticity, as used herein, refers to "the retention of neuromuscular changes made to meet the heightened demands".

Grips, as used herein is one type of user interface that may be stationary, or move such as revolve about its own axis or rotate in an orbital path about another axis, or move back and forth in a linear motion orthogonal to an orbital plane, for example.

Motion as used within the context of this invention to describe the motion imparted by the apparatus may be synchronized and multi-dimensional motion derived from the user's tremor parameters; amplitude, frequency and direction.

Three-dimensional spectrum analyzer is a portable device like a smart phone with a vibration analysis application or may be a built-in feature of the apparatus.

Synchronized motion, or motion that is substantially in phase with a user's tremor is within a cycle frequency of said user's tremor, or within about 20% of the user's tremor frequency, as measured by a spectrum analyzer.

A linear offset distance is substantially the same as a measured user's tremor amplitude when it is within about 20% of the measured user's tremor amplitude.

The linear motion is substantially aligned with the rotational axis when the linear motion is within about 20 degrees of the rotational axis.

An exemplary neuromuscular plasticity apparatus produces driven orbital motion of a user interface at a frequency and may also provide linear motion to the user interface. The amplitude and frequency may be set by a user or may be automatically set.

Figure 5:
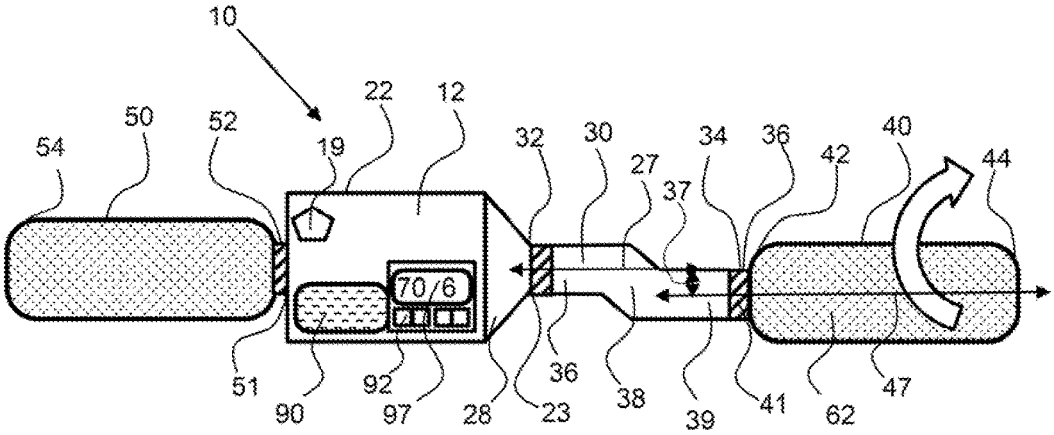
FIG. 5 shows an exemplary neuromuscular plasticity apparatus that provides an orbital motion of a user interface.
Figure 6:
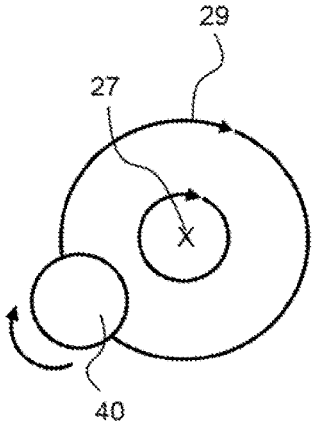
FIG. 6 shows the motion path of the revolving grip, or first user interface, from FIG. 5.
Figure 7:
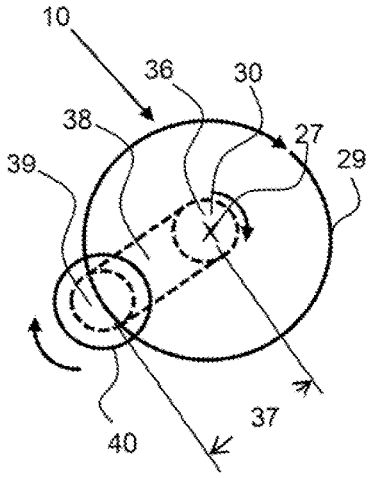
FIG. 7 shows a first end view of the exemplary neuromuscular plasticity apparatus shown in FIG. 5 and the motion path of the revolving grip in an orbital direction.

Referring to FIGS. 5 to 7, an exemplary neuromuscular plasticity apparatus 10 provides an orbital motion, as indicated by the bold curved arrow, of a first user interface 40. The first user interface has a connected end 42, an extended end 44 and a rotational axis 47, or axis about which it rotates. The revolving grip 62, of the first user interface, spins with respect to the coupler, such as a coupler bit 30, about the rotational axis 47 of the user interface. This rotational axis of the user interface is offset an offset radius distance 37 from the rotational axis of the rotational drive device 12, such as a motor. The coupler bit has a drive portion 36 that extends from the rotational drive device 12, an electric motor 22, an offset portion 38 that extends at an angle from the rotation axis 27 of the rotation device, and a user interface end 39 that is coupled with the connected end 42 of the user interface. The coupler may extend out radially from the rotational axis of the rotational drive device and have a coupling feature, such as on the interface end of the coupler, for connecting the user interface thereto. The offset portion of the coupler bit 30 produces an orbital path of the first user interface when the rotation device 12 rotates the coupler bit 30, as shown in FIGS. 6 and 7. The coupler bit has a length from the drive end 32 to the extended end 34. The first user interface 40 has a length from the connected end 42 to the extended end 44 and is connected to the first end 23 of the rotational drive device 12 by a coupler bit 30 and a connector 41, such as a quick disconnect connector.

The first user interface travels an orbital path having a radius equal to the offset radius distance 37. A second user interface 50 is connected to the second end 25 of the rotational drive device 12 by a connector 51, which may be a quick connect connector. The second user interface has a connected end 52 and an extended end 54. The controller 19 controls the functions of the apparatus and has a user input feature 92, having buttons for changing rotation speed, for example. A display 97 shows the rotational speed and a resistance to rotation, for example. An orbital resistance feature 28 enables a user to change the rotational force of the rotational drive device, thereby making it harder or easier to stop the rotation of the first user interface 40. A sensor 90 measures the parameters of the system, such as rotation speed, torque or force of rotation and linear motion distance and frequency, for example. As shown in FIG. 6, the first user interface moves in an orbital path about the rotation axis 27 of the rotation drive device. As shown in FIG. 7, the offset portion 38 of the coupler bit 30 creates and offset radius distance 37 of rotation. A sensor 90 may monitor the resistance to the rotation of the motor shaft and may control the power output as a result of resistance measured.

Figure 8:
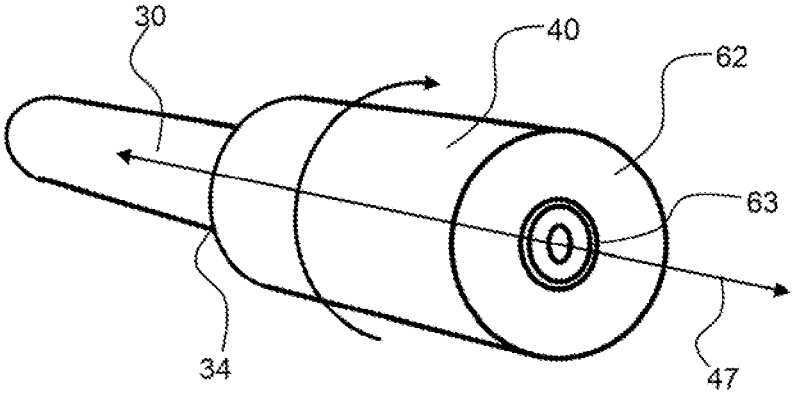
FIG. 8 shows a revolving grip that spins about a central bearing and is coupled to the coupler.

As shown in FIG. 8 shows a revolving grip 62 that spins about a central bearing 63 and about the rotational axis 47 of the user interface 40, and is coupled to the coupler bit 30. This allows low friction against a user's hand when the tremor suppression apparatus rotates the user interface 40 in an orbital path.

Figure 9:
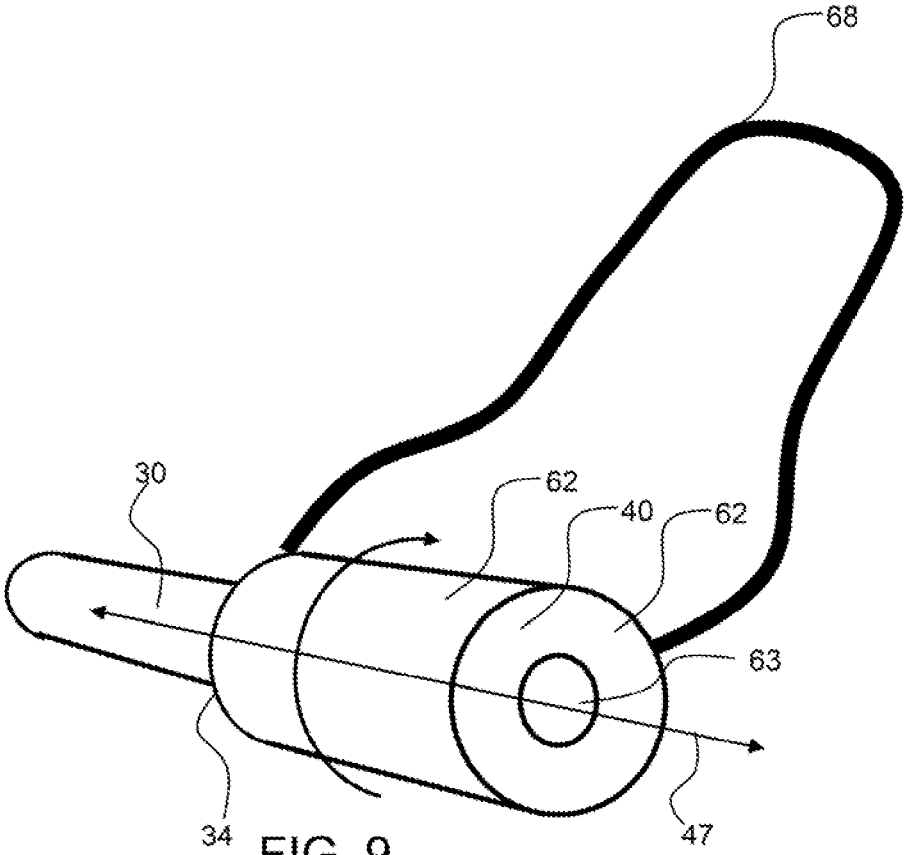
FIG. 9 shows a strap attached to the user interface.

As shown in FIG. 9, an exemplary strap 68 is attached to the user interface 40 and may be coupled around a body or is grasped to produce motion of the user's body part.

Figure 10:
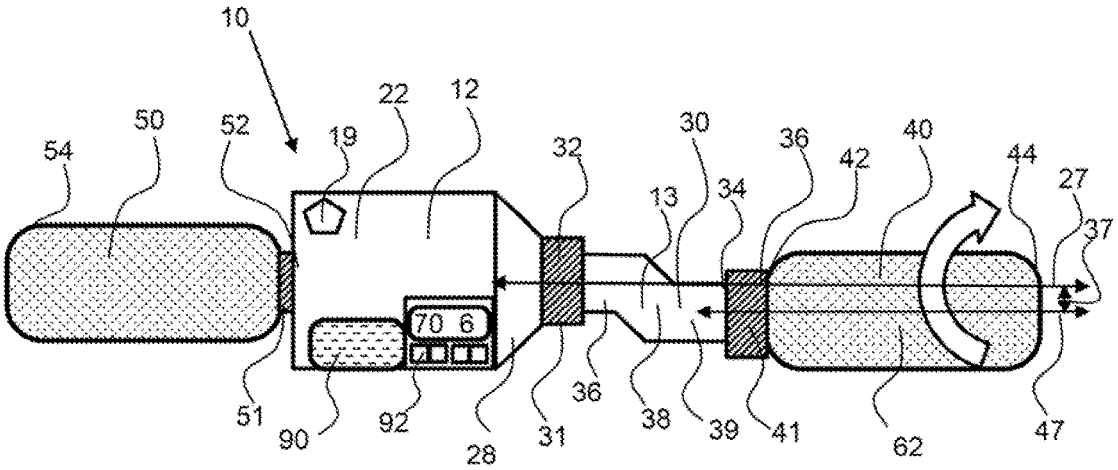
FIG. 10 shows an exemplary neuromuscular plasticity apparatus that provides an orbital motion of a user interface with a first and second user interface connected to a rotation drive device by connectors.

As shown in FIG. 10, an exemplary neuromuscular plasticity apparatus 10 provides an orbital motion, as indicated by the bold curved arrow, of a first user interface 40. The revolving grip 62 spins with respect to the coupler bit 30. The couple bit is connected to the rotational drive device 12, by a connector 31, such as a quick connector, to allow the coupler bit to be exchanged for a different coupler bit, such as one having a different offset radius. A user may change the offset radius of the first user interface 40 by simply connecting the first user interface to coupler bit 30 having a desired offset radius and connect the coupler bit to the rotational drive device.

Figure 11:
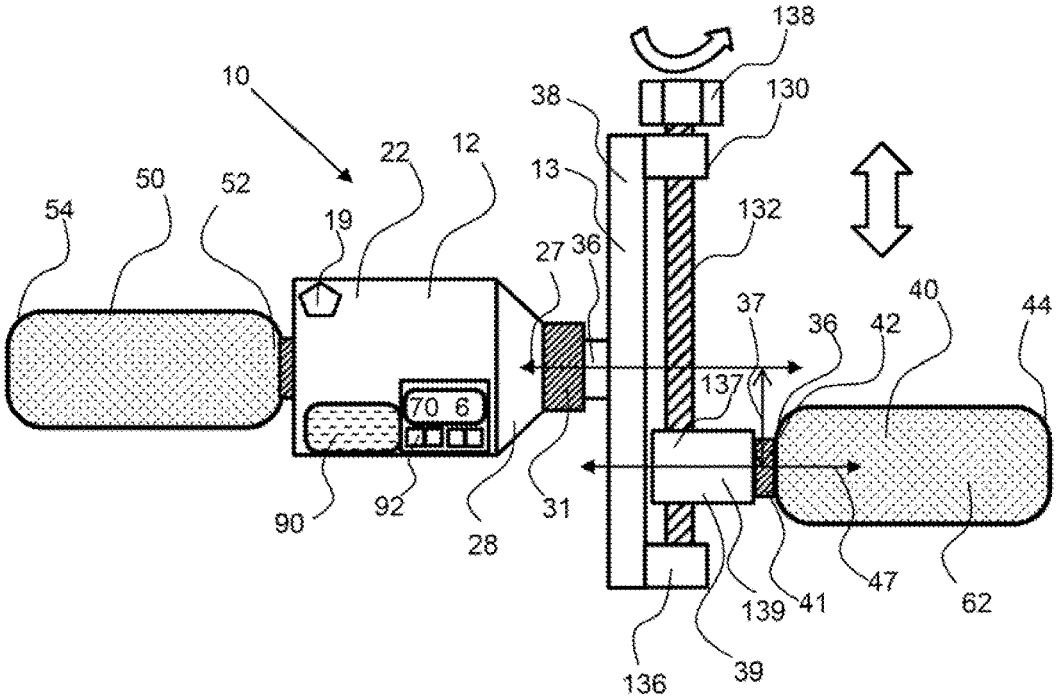
FIG. 11 shows an exemplary neuromuscular plasticity apparatus having a variable offset coupler to change the radius of orbital path of the first user interface.

As shown in FIG. 11, an exemplary neuromuscular plasticity apparatus 10 has a variable offset coupler 130, to change the orbital path of the first user interface 40. The variable offset coupler comprises a lead screw 132 that can be rotated to change the offset radius of the first user interface. The first user interface is attached to screw coupler 139 by a connector 41. The screw coupler has a threaded aperture 137 that interfaces with the lead screw threads to move the first user interface along the lead screw when the lead screw is rotated by the biaxial adjustment feature 138, such as a knob. A user can change the offset radius 37, the distance from the drive axis 27 to the rotational axis 47 of the first user interface. Grommets 136 are configured along the lead screw to secure it to the frame.

Figure 12:
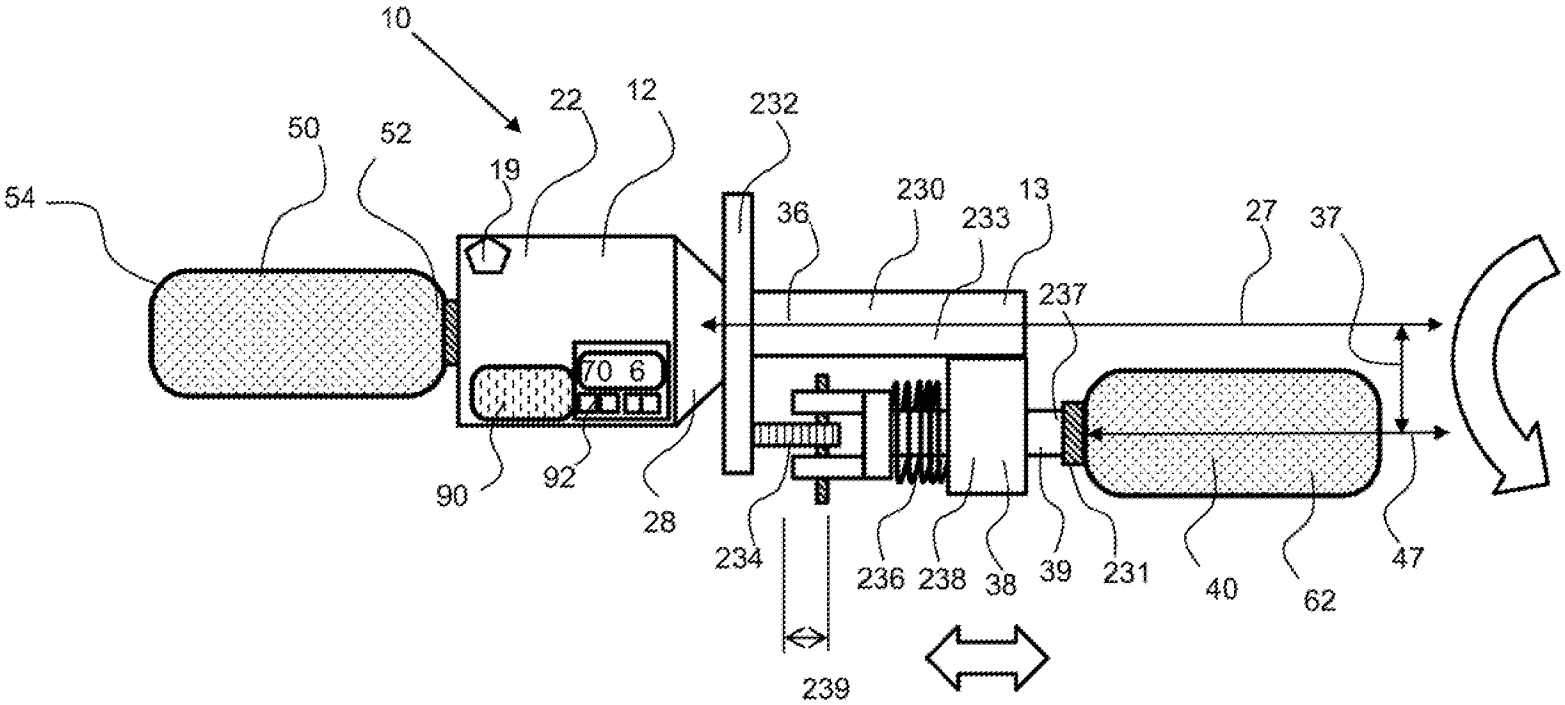
FIG. 12 shows an exemplary neuromuscular plasticity apparatus having a linear motion wheel that creates linear motion of the first user interface.
Figure 16:
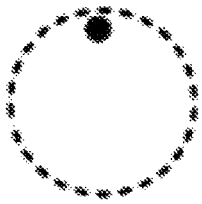
FIGS. 16 and 17 show orbital paths of the linear motion created by the linear motion wheel of FIG. 12 to 15.
Figure 17:
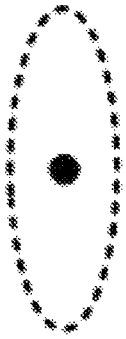

As shown in FIG. 12, an exemplary neuromuscular plasticity apparatus 10 has a biaxial coupler 230 that produces both orbital motion and linear motion. A linear motion apparatus 233 creates linear motion as the coupler 13 spins. A linear motion wheel 234 rolls along the surface of plate 232 by the rotational drive device 12 and about the drive rotational axis 27. The wheel is coupled to a linear bit 237 that extends through a linear bearing 238. A spring dampens the motion and keeps the linear motion wheel pressed against the plate 232. The wheel may be oval shaped, as shown in FIG. 17, or have an off-center rotational axis, as shown in FIG. 16 to produce linear motion of the user interface 40. The plate 232 may be a fixed plate the is coupled with the motor housing.

Figure 13:
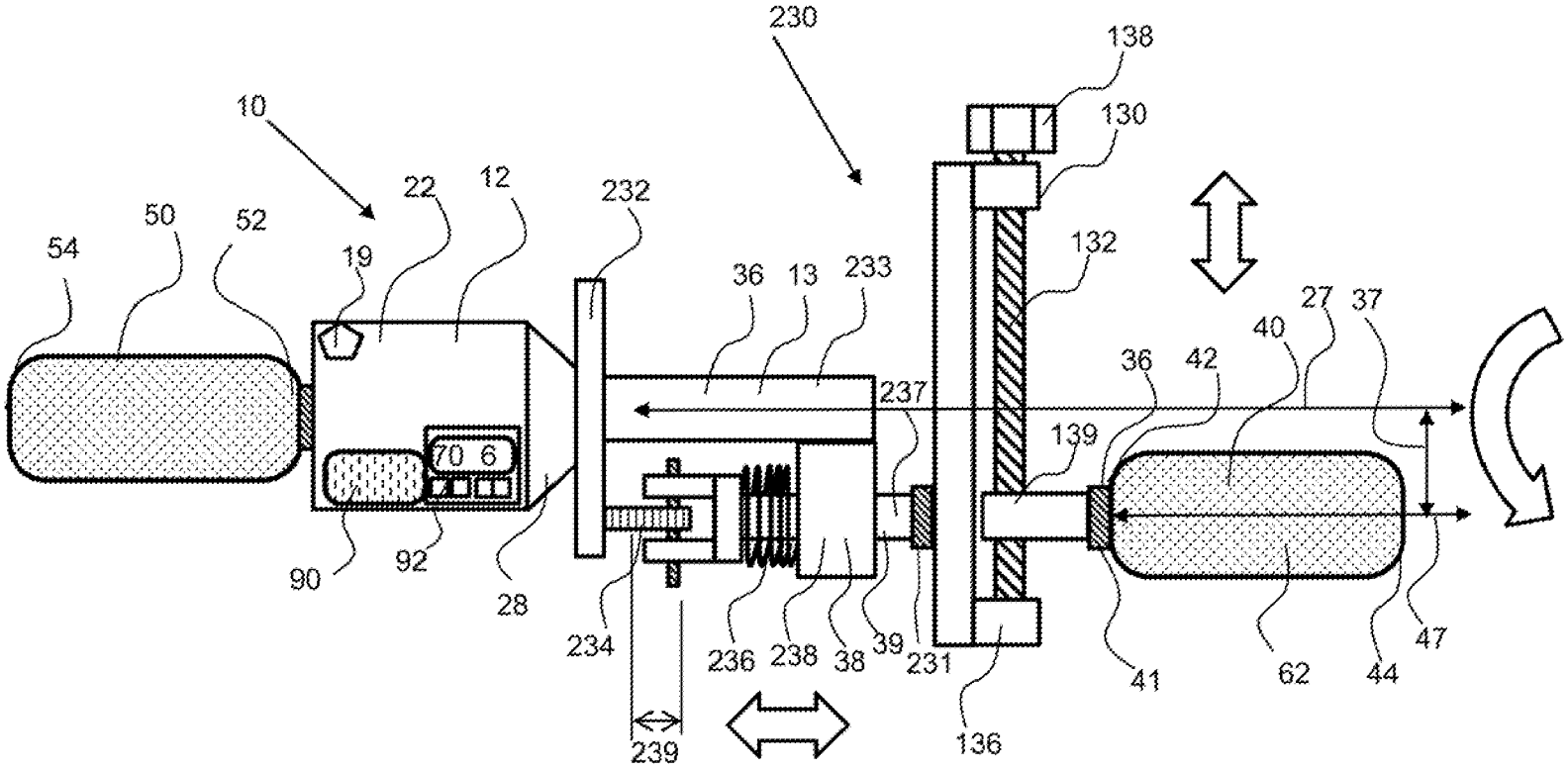
FIG. 13 shows an exemplary neuromuscular plasticity apparatus having a variable offset coupler to change the radius of orbital path and couplers to produce both orbital motion and linear motion.

As shown in FIG. 13, an exemplary neuromuscular plasticity apparatus 10 has a biaxial coupler 230 that produces both orbital motion and linear motion simultaneously. A variable offset coupler 130 is coupled with the linear bit 237 by a connector 231 and as described for FIG. 11, enables a variable offset radius. The linear motion wheel 234 may be exchanged to change the linear offset distance 239, or the stroke length of the linear motion.

Figure 14:
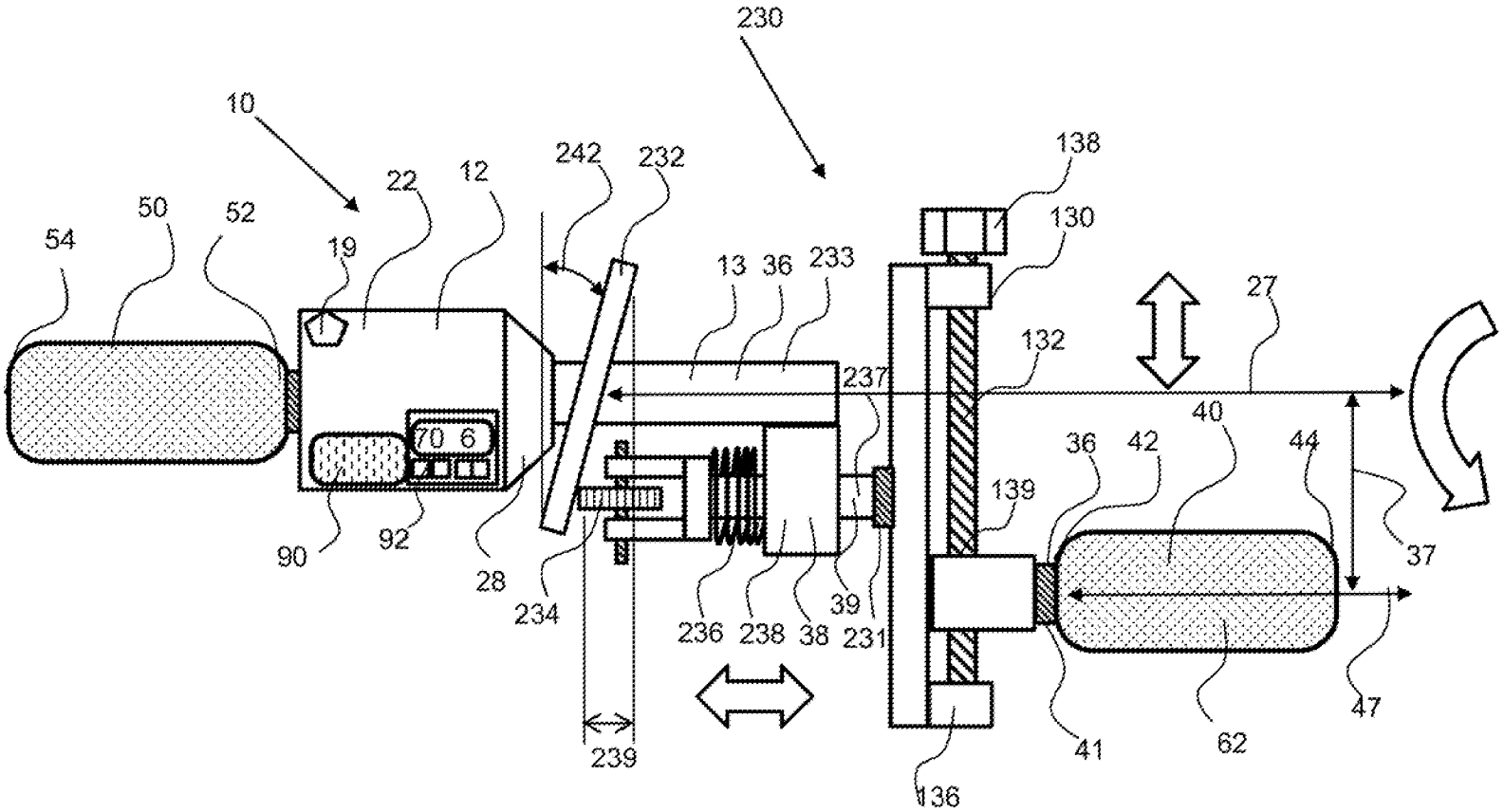
FIG. 14 shows an exemplary neuromuscular plasticity apparatus having a variable offset coupler to change the radius of orbital path a linear motion wheel contact plate at an offset angle to produce variable linear motion.

As shown in FIG. 14, an exemplary neuromuscular plasticity apparatus 10 has a biaxial coupler 230 that produces both orbital motion and linear motion simultaneously. The biaxial coupler 230 has a linear motion apparatus 233, and a variable offset coupler 130, for adjusting the offset radius distance 37. The linear motion wheel moves around the plate 232 that is at an offset angle and thereby produces oscillations in the vertical direction that are in-line with the rotational axis 27. The wheel 234 and first user interface will move up and down a vertical offset distance that is a function of the offset angle 242 of the plate 232 and distance of the wheel from the rotational axis 27. When the wheel is closer to the rotational axis the vertical offset distance will be reduced.

Figure 15:
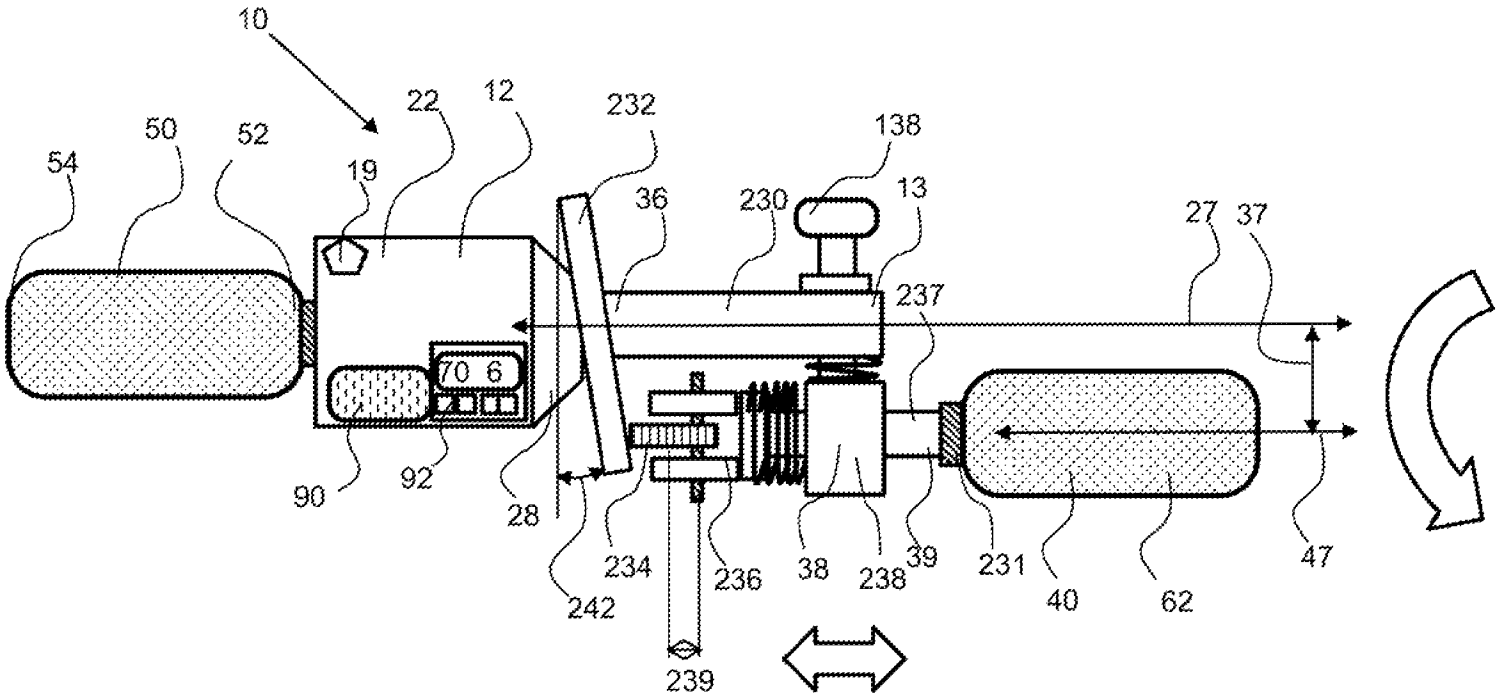
FIG. 15 shows an exemplary neuromuscular plasticity apparatus having a biaxial coupler that has an adjustment that changes both the radial and linear motion.

As shown in FIG. 15, an exemplary neuromuscular plasticity apparatus 10 has a biaxial coupler 230 that produces both orbital motion and linear motion simultaneously. The biaxial coupler 230 provides a knob that moves the user interface radial from the drive rotational axis 27, thereby increasing or decreasing the orbital path or diameter of the first user interface 40, having a straight grip 62. The linear motion wheel 234 rolls along the surface of plate 232 that is fixed to the motor housing at an offset angle and will therefore produce linear motion of the first user interface 40, as the wheel rotates about the drive rotational axis. Note that changing the radial offset distance, or distance of the user interface from the drive rotational axis will simultaneously change the linear motion stroke, as the amount of linear motion displacement increases with radial distance from the drive rotational axis. Turning the biaxial adjustment feature 138, or knob, will affect both the orbital and linear motion. As shown in FIG. 15 the wheel 234 has an axel 235 that is not centered, thereby producing vertical displacement with every rotation. In addition, the wheel will have a vertical offset due to the offset angle 242 of the place 232. This combination will produce a bimodal frequency of vertical offset, a higher frequency offset generated by the offset wheel axel and a lower frequency offset by the offset angle of the plate.

As shown in FIGS. 16 and 17, the path of motion of the linear motion wheel 234 may be varied as a function of the shape and diameter of the wheel, as well as the position of the rotational axis.

Figure 18:
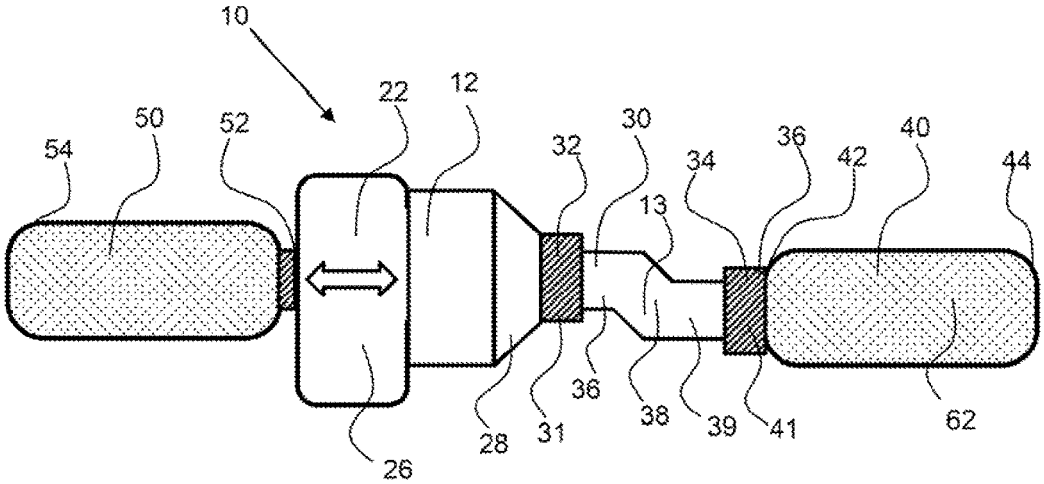
FIG. 18 shows an exemplary neuromuscular plasticity apparatus having a linear motion drive device for the second user interface and an orbital motion device for the first user interface.

As shown in FIG. 18, an exemplary neuromuscular plasticity apparatus 10 has a linear drive device 26 that creates linear motion back and forth of the coupler bit 30 as the coupler bit rotates. A coupler bit may be a one-piece extension from the rotational drive device, such as a single rod or tube. The neuromuscular plasticity apparatus 10 produces both orbital motion, or rotational motion, and linear motion simultaneously. A user may grip or otherwise engage with both the first user interface 40 and the second user interface 50.

Figure 19:
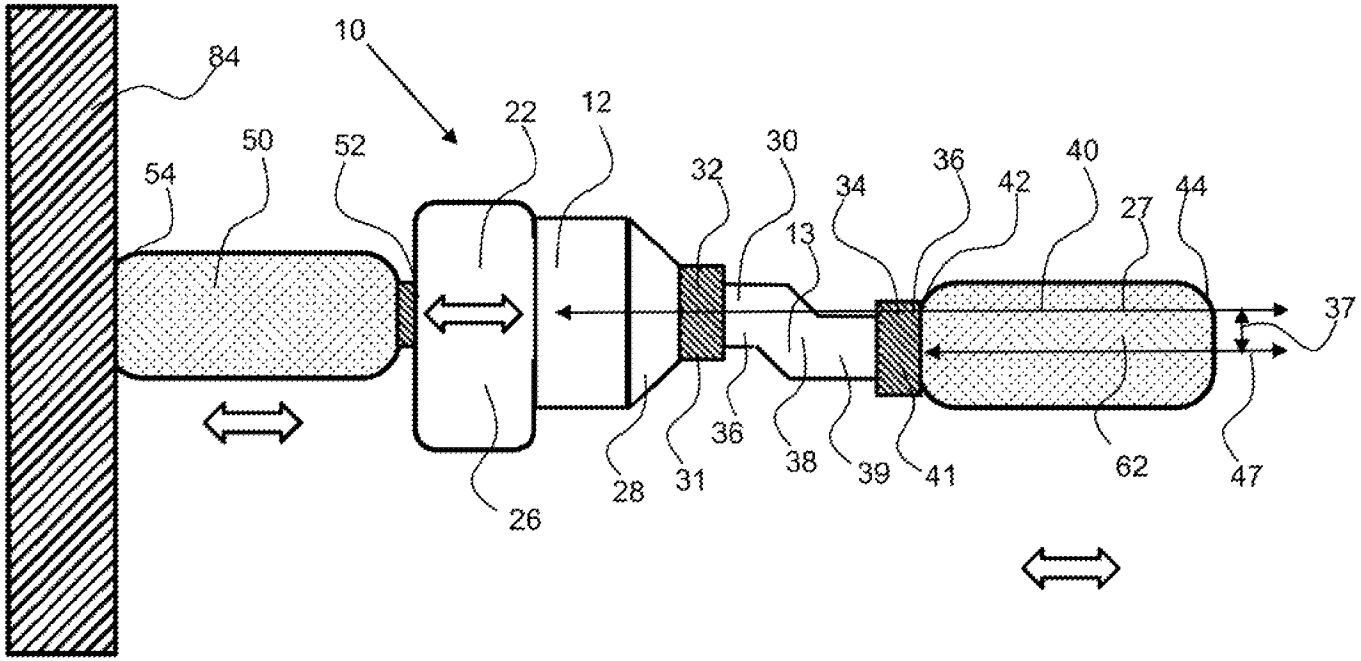
FIG. 19 shows an exemplary neuromuscular plasticity apparatus having one end fixed in position.

As shown in FIG. 19, an exemplary neuromuscular plasticity apparatus 10 has a linear drive device 26 that creates linear motion back and forth of the coupler bit 30 as the coupler bit rotates. The neuromuscular plasticity apparatus 10 produces both orbital motion, or rotational motion, and linear motion simultaneously. The second extended end 54 of the apparatus is fixed to a stationary support. The stationary support may be used with any apparatus configuration. Its purpose is to fix the second user interface so all the motion is transferred to the first user interface, orbital or orbital and linear motion. Further, when the user grasps the first user interface with both hands, the forced motion is the same for both hands as opposed to 180 degrees out of phase when the user grasps a user interface in one hand and the other user interface in the other hand. The same thing exists for legs/feet.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A neuromuscular plasticity apparatus comprising:

a) a rotational drive device;

b) a first user interface coupled to the rotational drive device by a coupler, wherein the rotational drive device rotates the coupler about a rotational axis at a rotation frequency;

said coupler comprising:

a drive end that is connected with the rotational drive device;

a user interface end;

an offset portion between the drive end and the first user interface that offsets the first user interface from the rotational axis of the rotational drive device to produce an offset radius distance of the first user interface that creates an orbital path of the first user interface when the rotational drive device rotates the coupler c) a linear motion apparatus that produces linear motion of the first user interface having a linear offset distance and a linear motion frequency, wherein the linear motion is substantially aligned with the rotational axis;

wherein motion of the user's limb by the neuromuscular plasticity apparatus improves said user's neuromuscular plasticity:

wherein the neuromuscular plasticity apparatus is portable and can be held in a user's hands during use.

2. The neuromuscular plasticity apparatus of claim 1, wherein the rotational drive device is an electric motor.

3. The neuromuscular plasticity apparatus of claim 2, wherein the first user interface extends from a first side of the rotational drive device and a second user interface extends from a second side of the rotational drive device.

4. The neuromuscular plasticity apparatus of claim 3, wherein the second user interface comprises a grip.

5. The neuromuscular plasticity apparatus of claim 1, wherein the coupler is a coupler bit having the offset portion that extends at an angle relative to the rotational axis of the rotational drive device.

6. The neuromuscular plasticity apparatus of claim 5, wherein the coupler bit is detachably attachable to the rotational drive device by a coupler bit connector.

7. The neuromuscular plasticity apparatus of claim 5, wherein the first user interface is a revolving grip comprising a grip and wherein said grip spins with respect to the coupler bit.

8. The neuromuscular plasticity apparatus of claim 1, wherein the coupler is a variable offset coupler comprising a variable offset distance feature to adjust the offset radius distance of the first user interface with respect to the rotational axis.

9. The neuromuscular plasticity apparatus of claim 8, wherein the variable offset distance feature comprises a lead screw and a screw coupler having a threaded aperture that is engaged with the lead screw;

wherein the first user interface is coupled with the screw coupler; and whereby rotation of the lead screw moves the screw coupler along the lead screw to change the offset radius.

10. The neuromuscular plasticity apparatus of claim 1, wherein the linear motion apparatus comprises:

a) a plate coupled with the rotational drive device at offset angle to the rotational axis;

b) a linear motion wheel that rolls along said plate and produces linear motion; and c) a linear bit coupled with the linear motion wheel and configured between the linear motion wheel and the first user interface;

wherein the first user interface is coupled to the linear bit to produce said linear motion; and wherein the first user interface is coupled to the linear bit at said offset radius distance to produce biaxial motion of the first user interface, rotational motion about an orbital path of the rotational axis, and linear motion.

11. The neuromuscular plasticity apparatus of claim 10, wherein the wheel has an offset axis thereby producing linear motion with each revolution of the wheel.

12. The neuromuscular plasticity apparatus of claim 10, wherein the plate is configured at an offset angle thereby producing linear motion of the wheel as it rotates about said wheel.

13. The neuromuscular plasticity apparatus of claim 12, comprising a biaxial coupler that adjusts the linear motion and the offset radius distance simultaneously, wherein a biaxial adjustment feature changes the offset radius distance of the first user interface and also an offset distance of the wheel to the rotational axis of the rotation drive device, thereby changing the linear offset distance.

14. A method of suppressing a tremor comprising:

a) providing a neuromuscular plasticity apparatus comprising:

i) a rotational drive device;

ii) a first user interface coupled to the rotational drive device by a coupler, wherein the rotational drive device rotates the coupler about a rotational axis at a rotation frequency;

said coupler comprising:

a drive end that is connected with the rotational drive device;

an offset portion between the drive end and the first user interface that offsets the first user interface from the rotational axis of the rotational drive device to produce an offset radius distance of the first user interface that creates an orbital path of the first user interface when the rotational drive device rotates the coupler;

b) measuring a user's tremor frequency;

c) coupling the first user interface with a user's body part;

d) setting the rotation frequency of said rotational drive device to a set rotational frequency that is substantially the same as said user's measured tremor frequency; and e) moving the first user interface about the rotational axis at said set rotational frequency by said rotational drive device to move said user's body part in an orbital path at substantially said user's measured tremor frequency.

15. The method of suppressing a tremor of claim 14, wherein the step of measuring a user's tremor frequency is conducted with a 3-dimensional spectrum analyzer.

16. The method suppressing a tremor of claim 15, wherein the user's tremor frequency is automatically input into the neuromuscular plasticity apparatus and the rotational frequency is automatically set.

17. The method of tremor suppression of claim 14, wherein the rotational frequency is between 3 Hz and 8 Hz.

18. The method of suppressing a tremor of claim 14, wherein the rotational drive device is an electric motor; wherein the coupler is a coupler bit and wherein the first user interface is a revolving grip comprising a grip and wherein said grip spins with respect to the coupler bit and wherein the user's body part is a user's hand and wherein the step of coupling the first user interface with a user's body part comprises the step of said user gripping the grip while the grip moves in said orbital path.

19. The method of suppressing a tremor of claim 14, wherein the coupler is a variable offset coupler comprising a variable offset distance feature to adjust the offset radius distance of the first user interface with respect to the rotational axis.

20. The method of suppressing a tremor of claim 14, wherein the neuromuscular plasticity apparatus comprises a linear motion apparatus that produces linear motion of the first user interface having a linear offset distance and a linear motion frequency, wherein the linear motion is substantially aligned with the rotational axis; wherein the linear motion apparatus comprises:

a) a plate coupled with the rotational drive device at offset angle to the rotational axis;

b) a linear motion wheel that rolls along said plate and produces linear motion; and c) a linear bit coupled with the linear motion wheel and configured between the linear motion wheel and the first user interface;

wherein the first user interface is coupled to the linear bit to produce said linear motion; and wherein the first user interface is coupled to the linear bit at said offset radius distance to produce biaxial motion of the first user interface, rotational motion about an orbital path of the rotational axis, and linear motion.

21. The method of suppressing a tremor of claim 14, wherein the step of measuring a user's tremor parameters comprises measuring a user's tremor amplitude, and wherein the neuromuscular plasticity apparatus comprises a linear motion apparatus that produces linear motion of the first user interface having a linear offset distance and a linear motion frequency, wherein the linear motion is substantially aligned with the rotational axis wherein the user's tremor amplitude is used to set the linear offset distance.

22. The method of tremor suppression of claim 14, wherein the step of measuring a user's tremor parameters comprises measuring a user's tremor amplitude and wherein the offset radius distance is set to be substantially the same as the measured tremor amplitude.

23. The method of tremor suppression of claim 22, wherein the offset radius distance is set automatically by an input of the measured user's tremor amplitude.

* * * * *